US011208766B2

(12) United States Patent
Luo et al.

(10) Patent No.: US 11,208,766 B2
(45) Date of Patent: Dec. 28, 2021

(54) SURFACE TREATMENT COMPOSITION, ITS USE AND A METHOD FOR PRODUCING PAPER, BOARD OR THE LIKE

(71) Applicant: Kemira Oyj, Helsinki (FI)

(72) Inventors: Yuping Luo, Johns Creek, GA (US); Junhua Chen, Mableton, GA (US); Zheng Dang, Lilburn, GA (US); Jennifer Riser, Marietta, GA (US)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 16/644,175

(22) PCT Filed: Sep. 26, 2018

(86) PCT No.: PCT/FI2018/050692
§ 371 (c)(1),
(2) Date: Mar. 4, 2020

(87) PCT Pub. No.: WO2019/063881
PCT Pub. Date: Apr. 4, 2019

(65) Prior Publication Data

US 2020/0232165 A1 Jul. 23, 2020

Related U.S. Application Data

(60) Provisional application No. 62/565,141, filed on Sep. 29, 2017.

(30) Foreign Application Priority Data

Oct. 12, 2017 (FI) ..... 20175900

(51) Int. Cl.

| | |
|---|---|
| ***D21H 21/20*** | (2006.01) |
| ***D21H 17/37*** | (2006.01) |
| *D21H 17/28* | (2006.01) |
| *D21H 17/42* | (2006.01) |
| *D21H 21/10* | (2006.01) |
| *D21H 21/16* | (2006.01) |

(52) U.S. Cl.
CPC ..... *D21H 21/20* (2013.01); *D21H 17/375* (2013.01); *D21H 17/28* (2013.01); *D21H 17/42* (2013.01); *D21H 21/10* (2013.01); *D21H 21/16* (2013.01)

(58) Field of Classification Search
USPC ..... 162/168.3
See application file for complete search history.

(56) References Cited

U.S. PATENT DOCUMENTS

| | | | |
|---|---|---|---|
| 4,837,087 | A | 6/1989 | Floyd et al. |
| 2006/0270801 | A1 | 11/2006 | Hagiopol et al. |
| 2007/0078233 | A1 | 4/2007 | Proverb et al. |
| 2009/0165978 | A1 | 7/2009 | Hagiopol et al. |

FOREIGN PATENT DOCUMENTS

| | | | |
|---|---|---|---|
| WO | 2013192082 | A1 | 12/2013 |
| WO | 2015035297 | A1 | 3/2015 |
| WO | 2015038901 | A1 | 3/2015 |
| WO | 2015038905 | A1 | 3/2015 |
| WO | 2015075318 | A1 | 5/2015 |
| WO | 2016034776 | A1 | 3/2016 |
| WO | 2016085836 | A1 | 6/2016 |
| WO | 2017142511 | A1 | 8/2017 |

OTHER PUBLICATIONS

Finnish Patent and Registration Office, Search Report of Finnish patent application No. 20175900, dated May 9, 2018, 2 pages.

*Primary Examiner* — Mark Halpern
(74) *Attorney, Agent, or Firm* — Meunier Carlin & Curfman LLC

(57) ABSTRACT

A surface treatment composition is disclosed including anionic polyacrylamide, which has a weight average molecular weight, MW, in the range of 100 000-2 000 000 g/mol, and free glyoxal. Further disclosed is a use of the surface treatment composition, a method for producing paper, board or the like and a paper product.

14 Claims, 2 Drawing Sheets

SURFACE TREATMENT COMPOSITION, ITS USE AND A METHOD FOR PRODUCING PAPER, BOARD OR THE LIKE

PRIORITY

This application is a U.S. national application of the international application number PCT/F12018/050692 filed on Sep. 26, 2018 and claiming priority of provisional application 62/565,141 filed on Sep. 29, 2017 and Finnish application 20175900 filed on Oct. 12, 2017 the contents of all of which are incorporated herein by reference.

FIELD OF THE INVENTION

The present invention relates to a surface treatment composition for an application on a surface of paper, board or the like, and to the use of the surface treatment composition according to the enclosed claims. Further, the present invention relates to a method for producing paper, board or the like and to a paper product.

BACKGROUND OF THE INVENTION

Size press is a commonly used method to apply a starch solution onto the surface of the dry paper sheet, which is able to increase the surface strength of the paper. This technology can also provide other benefits including increased tensile and stiffness, and reduced air permeability. Additional chemicals with starch such as polystyrene acrylate emulsion (SAE), polystyrene maleic anhydride (SMA), styrene acrylic acids (SAA) or polyurethane dispersions (PUD) are used to control fluid penetration; whereas polyacrylamide and acrylic acid copolymers are used for further increase strength. Generally, higher molecular weight polymers tend to provide higher paper strength properties. However, the size press application requires low viscosity of the polymer solution in order that the polymer solution can be applied onto the surface of the paper. If the molecular weight of the polymer is high, its concentration in the solution to be applied might be so low that the application is not cost effective and probably the strength performance is also not desired.

Glyoxal cross-linked polyacrylamide (GPAM) is a widely used synthetic polymer for providing paper wet strength. As mill water discharge volumes decline and paper machines go to alkaline papermaking conditions, developing paper wet strength at the wet end through use of glyoxalated polyacrylamide (GPAM) wet strength resins becomes ever more challenging.

Consequently, there is a continuing need for novel papermaking additives, such as wet and/or dry strength agents for paper products, which would have a high and controllable molecular weight while being usable without the above-mentioned problems.

SUMMARY OF THE INVENTION

An object of this invention is to minimise or even eliminate the disadvantages existing in the prior art.

An object of the present invention is to provide a composition for treatment of a surface of paper, board or the like, by which the strength properties of paper, board or the like can be improved. Especially the object is to provide a surface treatment composition by which the wet strength and dry strength properties of paper, board or the like may be improved simultaneously.

Another object of the present invention is to provide a method for producing paper or board by applying the surface treatment composition, for example at the size press, onto the paper, board or the like and simultaneously also provide increased wet strength and dry strength properties.

Still another object of the present invention is to provide a simple and cost-effective method for producing paper, board or the like, which also improves runnability.

The object of the present invention is also to provide a paper product with improved strength properties. Especially it is an object to provide improved lightweight coated fine paper.

These objects are attained with a surface treatment composition and a method having the characteristics presented below in the characterizing parts of the independent claims. Some preferred embodiments are described in the dependent claims.

The embodiment examples and advantages mentioned in this text relate, as applicable, to a surface treatment composition, its use as well as to a method for producing paper, board or the like and a paper product, even if this is not always specifically stated.

A typical surface treatment composition for the application on a surface of paper, board or the like, wherein the surface treatment composition comprises

- anionic polyacrylamide, which has an average molecular weight, MW, in the range of 100 000-2 000 000 g/mol, and
- free glyoxal.

Typically, the surface treatment composition according to the present invention is used for surface sizing to improve wet and dry strength properties of paper, board or the like, while maintaining repulpability of paper, board or the like.

Typical method according to the present invention for producing paper, board or the like, comprises

- obtaining a fibre stock,
- forming a fibrous web from the fibre stock,
- drying the fibrous web to dryness of at least 60%, preferably at least 80%, more preferably at least 90%,
- applying on the surface of the fibrous web a surface treatment composition according to the present invention, wherein a surface treated fibrous web is obtained and
- drying the surface treated fibrous web.

Typical paper product according to the invention is obtainable by the method according to the present invention, wherein the paper product comprises in-situ glyoxylated polyacrylamide on the surface of the paper.

Now, it has been observed that it may be possible to achieve improvements in wet and dry strength properties of the paper or board by applying the surface treatment composition according to the present invention on the surface of said paper or board web so that the building of the glyoxylated polyacrylamide network on the paper or board surface is possible in-situ during the paper or board manufacturing processes. This kind of application, for example size press application, may provide high molecular weight of the polymer and the polymer may form strong covalent bonds with cellulose fibres, which are also less sensitive to hydrolysis upon de-hydration. In other words, the present invention provides an in-situ method for increasing the molecular weight of the polymer, in which method an anionic polyacrylamide having viscosity low enough for size press application is applied on the surface of the paper or board and the molecular weight of the anionic polyacrylamide is increased by reacting glyoxal with the polyacrylamide in-situ, whereby the improved strength properties of the paper or board is achieved.

It has also been observed that it may be possible to achieve improvements in several of the following strength properties of the paper or board, namely dry tensile strength, wet strength after 30 min soak, representing permanent wet strength, and/or STFI compression strength, by using the surface treatment composition according to the present invention for treating or sizing the surface of the paper or board web.

Especially the improvement in permanent wet strength obtained by using the present surface treatment composition may be desirable, as it may allow dosage reduction of polyamidoamine epichlorohydrin (PAE), a common permanent wet strength resin, to fibre stock when manufacturing paper or board grades requiring permanent wet strength. Reduction of wet strength PAE dosage would improve repulpability of the paper or board, thereby reducing amount of rejects and waste at paper mills. The surface treatment composition according to the invention also provides a wet strength source not containing epichlorohydrin.

Further, when the presented surface treatment composition is applied with surface size starch, it may provide paper or board with enhanced wet strength as well as dry strength properties. It has also been observed that it increases paper stiffness by further improving starch film forming properties. Additionally, it may be possible to achieve the desired surface properties with lower amount of starch. In addition, the surface treatment composition according to the invention may further comprise hydrophobic sizing polymer, such as styrene-acrylic acid ester polymer (SAE), which may be applied alone or with the starch, for improvements in sizing. When the hydrophobic sizing polymer is used in the surface treatment composition according to the invention, it may be possible to compensate for the strength loss typically caused by hydrophobic sizing polymers. Without wishing to be bound by any theory it is believed that at least some of the benefits may result from the increased interactions between the anionic polyacrylamide and starch and/or hydrophobic sizing polymer, caused by the in-situ glyoxylation, including formation of new chemical bonds e.g. by crosslinking, and/or physical entanglement.

DESCRIPTION OF THE DRAWINGS

The invention will be described in more detail with reference to appended drawings, in which.

DETAILED DESCRIPTION OF THE INVENTION

Figure 1:
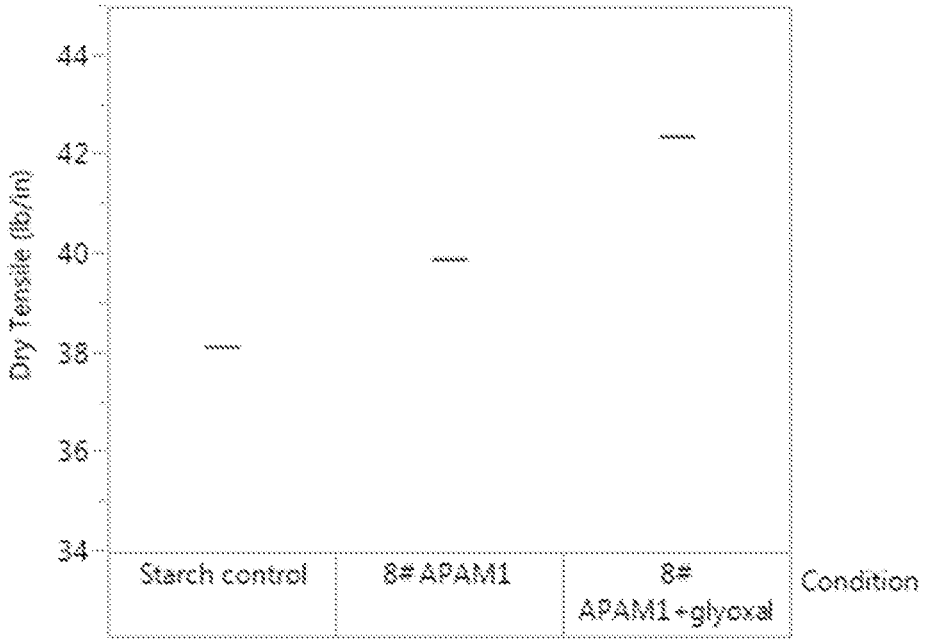
FIG. 1 shows the dry tensile results according to Example 2.

The present invention relates to a surface treatment composition for an application on a surface of paper, board or the like, which composition comprises anionic polyacrylamide and free glyoxal. The surface treatment composition includes free glyoxal which means unreacted glyoxal and which is a component comprising at least two aldehyde functional groups, that are capable of forming covalent bonds to amide group present in the anionic polyacrylamide. Preferably the surface treatment composition according to the present invention is in a form of an aqueous solution or dispersion.

According to an embodiment of the invention, the surface treatment composition may further comprise glyoxylated polymer, preferably glyoxylated polyacrylamide. When free glyoxal or a combination of free glyoxal and glyoxylated polymer is applied on the surface of the paper or board with anionic polyacrylamide, the formation of bonds between the aldehyde functional groups and anionic polyacrylamide is performed in-situ during the paper and board manufacturing process. Glyoxal provides more aldehyde groups per gram than glyoxylated polymers, and on the other hand has very low molecular weight and therefore may provide better control of the viscosity of the surface treatment composition.

It has been observed that the surface treatment composition according to the present invention comprising anionic polyacrylamide does not cause charge shock when added to surface size starch which may be at least slightly anionic. In principle, also nonionic polyacrylamide may be used since it reacts with glyoxal but then it would lack carboxyl groups of anionic monomers that contribute to strength generation.

Anionic polyacrylamide (APAM) of the surface treatment composition according to the present invention may be a linear or cross-linked copolymer of (meth)acrylamide and at least one anionic monomer, such as unsaturated carboxylic acid monomer. Preferably the anionic monomer is selected from unsaturated mono- or dicarboxylic acids, such as acrylic acid, methacrylic acid, maleic acid, itaconic acid, crotonic acid, isocrotonic acid, and any combination thereof. Also other anionic monomers, such as vinylsulphonic acid, 2-acrylamide-2-methylpropanesulfonic acid, styrene sulfonic acid, vinyl phosphonic acid or ethylene glycol methacrylate phosphate, may be included. The anionic monomers may be in acid form, as their corresponding water soluble or dispersible alkali metal, alkaline earth metal, and ammonium salts, and any combinations thereof. According to one preferable embodiment the anionic polyacrylamide comprises a copolymer of acrylamide and unsaturated carboxylic acid monomers, such as (meth)acrylic acid, maleic acid, crotonic acid, itaconic acid or any combination thereof. Preferably the anionic polyacrylamide comprises a copolymer of acrylamide and acrylic acid, or a copolymer of acrylamide and itaconic acid, or a copolymer of acrylamide and methacrylic acid. The anionic polyacrylamide may also comprise a partially hydrolysed poly(meth)acrylamide, obtainable by polymerizing (meth)acrylamide monomers to obtain a poly(meth)acrylamide followed by a partial acid or alkali hydrolysis of the poly(meth)acrylamide to obtain the anionic polyacrylamide.

According to one preferred embodiment of the invention anionic polyacrylamide may comprise anionic monomers and (meth)acrylamide in a molar ratio of 3:97 to 30:75 or 3:97 to 30:70, preferably 5:95 to 20:80, or 5:95 to 15:85, in order to achieve desired paper wet strength properties. The more carboxyl groups present in the polymer, the better strength generation, but if too many anionic monomers are present then there is not enough acrylamide whose amide groups are needed for reaction with aldehyde and then the molecular weight of the in-situ formed glyoxalated polyacrylamide remains low with lower strength generation.

Anionic polyacrylamide may comprise, in addition to the acrylamide and anionic monomers, small amounts of other polymerization additives, such as cross-linker monomers. An example of a suitable cross-linker monomer is methylene bisacrylamide. The amount of these polymerization additives is, however, small, such as <1000 ppm, typically <600 ppm, more typically <100 ppm, sometimes even <10 ppm.

According to an embodiment of the invention the anionic polyacrylamide has anionicity in the range of 3-30 mol-%, preferably 5-20 mol-%, such as 5-15 mol-%.

The anionic polyacrylamide may be obtained by solution polymerization, emulsion polymerization, dispersion polymerization, or gel polymerization. Accordingly, the anionic polyacrylamide may be in the form of a solution polymer, an emulsion polymer, a dispersion polymer, or a dry powder. Preferably the anionic polyacrylamide is a solution polymer with a dry solids content of 10-30 weight-%, providing easier preparation of the surface treatment composition. If dry polymer is used, it may be dissolved and diluted to water to obtain 0.5-3 weight-% concentration of polymeric substance before use.

According to one preferable embodiment of the present invention the anionic polyacrylamide has an average molecular weight, MW, in the range of 100 000-2 000 000 g/mol, preferably 200 000-1 000 000 g/mol. The good strength properties with in-situ glyoxylation of the anionic polyacrylamide, may be achieved when the average molecular weight of anionic polyacrylamide is 100 000 g/mol or more. The molecular weight of the anionic polyacrylamide affects viscosity of the polymer solution and so its applicability by size press. The anionic polyacrylamide is applicable by size press at reasonable concentration even up to average molecular weight of 2 000 000 g/mol. If the molecular weight of the anionic polymer was higher, a lower concentration thereof should be used in the surface treatment composition to provide applicability by size press, meaning higher amount of water to be applied on the paper surface, and thus higher need for drying capacity, and even increased risk of web breakage.

The value of "average molecular weight" reflects the magnitude of the polymer chain length. The weight average molecular weight values may be measured by size exclusion chromatography, such as GPC (gel permeation chromatography). Alternatively, average molecular weight values may be calculated from intrinsic viscosity results measured in a known manner in 1N NaCl at 25° C. by using an Ubbelohde capillary viscometer. The capillary selected is appropriate, and in the measurements an Ubbelohde capillary viscometer with constant K=0.005228 may be used. The average molecular weight may then be calculated from intrinsic viscosity result in a known manner using Mark-Houwink equation $[\eta]=K\cdot Ma$, where $[\eta]$ is intrinsic viscosity, M molecular weight (g/mol), and K and a are parameters given in Polymer Handbook, Fourth Edition, Volume 2, Editors: J. Brandrup, E. H. Immergut and E. A. Grulke, John Wiley & Sons, Inc., USA, 1999, p. VII/11 for poly(acrylamide). Accordingly, value of parameter K is 0.0191 ml/g and value of parameter a is 0.71. The average molecular weight range given for the parameters in used conditions is 490 000-3 200 000 g/mol, but the same parameters may be used to describe the magnitude of molecular weight also outside this range.

An anionic polyacrylamide having optimal molecular weight may be obtained by degradation of dry anionic polyacrylamide. Typically, the degraded anionic polyacrylamide may be obtained by cleaving the backbone of the anionic high molecular weight (HMW) polyacrylamide in an aqueous solution by using a degradation agent, thereby providing a degraded anionic polyacrylamide having a decreased standard viscosity, and molecular weight, compared to the original anionic HMW polyacrylamide. In this way the molecular weight of the original anionic HMW polyacrylamide may be decreased in a controlled way in the aqueous solution. As used herein, the term "degradation agent" refers to any compound or mixture of compounds which is capable of reducing the standard viscosity of an anionic polyacrylamide when in an aqueous environment by cleaving the backbone of the polyacrylamide, i.e. the main chain of the polyacrylamide, into fragments. The effect of the degradation agent and the cleavage of the polymer backbone can be seen in the decreasing viscosity of the aqueous medium comprising the polyacrylamide. The aqueous solution of the degraded anionic polyacrylamide is typically obtainable by dissolving a mix of dry anionic polyacrylamide and dry degradation agent in an aqueous medium. The dry anionic polyacrylamide easily degrades and dissolves into an aqueous medium, such as water, at ambient temperature in the presence of a suitable amount of degradation agent, whereby a solution comprising the degraded anionic polyacrylamide is obtained. The degradation agent, in dry or liquid form, may also be incorporated during the dissolution of the anionic polyacrylamide. The polymer concentration of the aqueous solution may be 0.1-10 weight-%, preferably 0.2-5 weight-%, more preferably 0.3-4 weight-%. The obtained degraded anionic polyacrylamide is chemically degraded. Conventional dissolving equipment may be used for preparing the degraded anionic polyacrylamide.

The degradation agent may be any compound or mixture of compounds capable of breaking, i.e. cleaving the backbone of the anionic polyacrylamide in an aqueous environment into smaller polymeric fragments. This has the effect of reducing the standard viscosity of the anionic polyacrylamide polymer. The degradation agent may be selected from compounds or mixtures of compounds capable of reducing the standard viscosity of the anionic polyacrylamide by at least 10%, preferably by at least 20%, more preferably by at least 30%, even more preferably by at least 50%. As a comparison, a mere hydrolysis of functional groups from side chains of e.g. a (meth)acrylamide based copolymer does not cause sufficient reduction of viscosity. In one embodiment the degradation agent is selected from oxidizing degradation agents, reducing degradation agents, and any combinations thereof. Preferably, the degradation agent is a reducing degradation agent. In one embodiment the oxidizing degradation agent is selected from the group consisting of sodium percarbonate, sodium hypochlorite, sodium persulfate, potassium persulfate, ammonium persulfate, hydrogen peroxide, sodium perborate, and any combinations thereof. In one embodiment the reducing degradation agent is selected from the group consisting of an iron compound, sodium borohydride ($NaBH_4$), sodium dithionite, and any combination thereof. In a preferred embodiment, the degradation agent comprises an iron compound. This compound is advantageously a ferrous compound such as a ferrous salt or a ferric compound such as a ferric salt, these being available in dry powder form.

The degradation agent may also be in the form of a solution. Iron compounds are generally environmentally friendly compounds. The term ferrous is used according to its customary meaning to indicate a divalent iron compound (+2 oxidation state or Fe(II)). The term ferric is used according to its customary meaning to indicate a trivalent iron compound (+3 oxidation state or Fe(III)). In an exemplary embodiment the ferrous salt comprises an organic anion, an inorganic anion, or a mixture thereof. In an advantageous embodiment, the ferrous salt is ferrous citrate, ferrous chloride, ferrous bromide, ferrous fluoride, ferrous sulfate, ammonium iron sulfate or combinations thereof. In one embodiment, the iron-containing degradation agent comprises ferrous sulfate. In an exemplary embodiment, the ferric salt comprises an organic anion, an inorganic anion, or a mixture thereof. In exemplary embodiments, the ferric salt is ferric citrate, ferric chloride, ferric bromide, ferric fluoride, ferric sulfate, and combinations thereof. The most advantageous polymer degradation agent for use in the present disclosure is iron(II)sulfate. Iron sulfate, in particular ferrous sulfate, is able to dissolve and degrade at ambient conditions whereas the other degradation agents require elevated temperature to achieve the same polymer degradation effectiveness. The degradation of anionic dry polyacrylamide in water can be easily controlled to make any molecular weight ranges by adjusting the degradation agent content at ambient temperatures. The obtained degraded anionic polyacrylamides may be used in surface treatment composition according to the invention.

According to an embodiment of the invention, the surface treatment composition may comprise anionic polyacrylamide and glyoxylated polymer in the weight ratio of 75:25 to 25:75 on dry weight basis.

According to an embodiment of the invention, the surface treatment composition comprises free glyoxal at least 0.2 weight-%, or 0.2-99 weight-%, preferably at least 1 weight-%, or 1-99 weight-%-%, calculated from anionic polyacrylamide (dry/dry). The amount of the free glyoxal in the surface treatment composition may vary if the surface treatment composition further comprises starch. In a presence of starch, the surface treatment composition may comprise free glyoxal at least 1 weight-%, preferably at least 10 weight-% or 20 weight-%, calculated from anionic polyacrylamide (dry/dry). The amount of the free glyoxal in the surface treatment composition may vary depending on whether the surface treatment composition further comprises starch. In some embodiments, especially in the presence of starch, the surface treatment composition may comprise free glyoxal at least 1 weight-%, such as 1-99 weight-%, preferably at least 10 weight-%, such as 10-90 weight-%, more preferably at least 20 weight-%, such as 20-80 weight-%, calculated from anionic polyacrylamide (dry/dry). In some other embodiments, especially in the absence of starch, the surface treatment composition may comprise free glyoxal 0.2-10 weight-%, preferably 1-10 weight-% and more preferably 1-6 weight-%, calculated from anionic polyacrylamide (dry/dry).

In an embodiment of the invention, a surface treatment composition according to the present invention has a pH of below 5, preferably below 4 and more preferably below 3. The lower the pH the better the stability of the surface treatment composition, so it may be easier to prevent polyacrylamide cross-linked by the aldehyde functional groups present in the composition during storage and distribution and so to prevent gelling of the surface treatment composition. The mixture of the surface treatment composition may also be prepared on site at paper mill just before the use.

According to one preferred embodiment of the invention, a surface treatment composition comprises in an aqueous medium anionic polyacrylamide, free glyoxal and starch. A surface treatment composition according to the present invention may be for example surface sizing composition or pre-coating composition or pigment coating composition.

The starch used in the surface treatment composition according to the present invention may be any starch commonly used for surface application. Preferably the starch is degraded starch, more preferably degraded and dissolved starch. Degraded starch may be obtained by subjecting the starch to oxidative, thermal, acidic or enzymatic degradation. As used herein, by degraded starch is also meant modified surface application starches such as starch esters, starch ethers, ethylated starch or propylated starch. According to one preferred embodiment of the invention the starch is enzyme treated, i.e. enzymatically degraded, or thermally degraded starch. For example, the starch can be enzymatically degraded on site at the paper or board mill and mixed with the anionic polyacrylamide at a sizing station. The degraded starch may be degraded uncharged native starch, or slightly anionic degraded starch.

The starch may be any suitable starch used in surface sizing, such as potato, rice, corn, waxy corn, wheat, barley or tapioca starch, preferably corn starch. It has been observed that the sizing results for paper and board, especially the various strength properties, which are obtained with the surface treatment compositions according to the present invention, are unexpectedly improved when anionic polyacrylamide is used in combination with the starch. The starch may assist in controlling the penetration of the anionic polyacrylamide in the fibre web.

According to the invention, the surface treatment composition may comprise starch, preferably degraded starch, in an amount of 99.5-1 weight-%, preferably 95-55 weight-%, calculated from the dry content of the surface treatment composition.

According to one aspect of the invention, it has been observed that the addition of the surface treatment composition according to the invention to the 9% starch size press solution did not significantly increase the starch solution viscosity at elevated temperature, which is typical for size press operation. The size press solution containing the surface treatment composition according to the invention was also found to be stable for an extended circulation time at elevated temperature.

In an embodiment according to the invention, the surface treatment composition may also comprise hydrophobic sizing polymer, preferably styrene acrylic acid ester polymer (SAE), styrene maleic anhydride polymer (SMA), styrene maleic anhydride ester polymer (SMAE), styrene acrylic acid polymer (SAA), ethylene acrylic acid polymer (EAA), polyurethane dispersion (PUD), or any modification or combination thereof. In addition to anionic polyacrylamide, free glyoxal and hydrophobic sizing polymer, such as SAE, the surface treatment composition according to the invention may optionally comprise starch. The embodiment comprising hydrophobic sizing polymer such as SAE may be beneficial when increased water-resistance of paper surface is desired, for example for preventing paper from blurring with water or ink, for increasing water or ink holdout, and for improving printability such as offset printing, and inkjet printing. Additionally, using the hydrophobic sizing polymer in the surface treatment composition may also have a positive impact on dusting, toner adhesion, smoothness, and air permeability, and may reduce ketone migration in AKD-sized paper grades. The combination of glyoxal, anionic polyacrylamide and hydrophobic sizing polymer, optionally together with starch, may provide further improvement in the sizing efficiency, as measurable e.g. by Hercules size test, and/or initial wet tensile, compared to using just the hydrophobic sizing polymer alone or optionally together with starch. Additionally, potential dry tensile loss caused by using the hydrophobic sizing polymer alone may be compensated in part or fully or even beyond that, by using the specific surface treatment combination of this embodiment. Although sizing efficiency and initial wet tensile might be improved also by applying increased dosages of hydrophobic sizing polymers in surface sizing compositions, this may be undesired for certain paper grades due to drawbacks caused by the increased hydrophobic sizing polymer dosage. Using the present embodiment according to the invention the same advantages may be achieved, without increasing the hydrophobic sizing polymer dosage. But when desired, by using the present embodiment according to the invention it may also be possible to increase the dosage of the hydrophobic sizing polymer while getting some of its drawbacks, such as the decreased dry tensile, compensated.

According to one preferred embodiment of the present invention the surface treatment composition has a dry content of 2-25 weight-%, preferably 5-25 weight-% and more preferably 10-20 weight-%, calculated from the total weight of the composition, wherein it is most applicable to e.g. size press application.

The surface treatment composition according to the invention is especially used for increasing strength properties of paper, board or the like. It has also been observed that the surface treatment composition according to the invention improves permanent wet strength while not decreasing repulpability. Repulpability may be maintained on a good level or not deteriorated, compared to paper not using the surface treatment composition according to the present invention. Especially, repulpability is improved compared to a reference paper manufactured using PAE wet strength resin. According to one embodiment of the present invention the surface treatment composition is especially suitable for treating the surface of the paper, which is selected from fine paper or printing paper. According to one embodiment of the invention, the surface treatment composition is also suitable for treating the surface of the board, which is used for manufacture of beverage carriers. These paper grades benefit a lot from the improved wet strength by the present invention as their manufacture or use typically requires rewetting or application of moist, so they are vulnerable to web breakage.

According to one embodiment of the invention the method for producing paper, board or the like, comprises

- obtaining a fibre stock,
- forming a fibrous web from the fibre stock,
- drying the fibrous web to dryness of at least 60%, preferably at least 80%, more preferably at least 90%,
- applying on the surface of the fibrous web a surface treatment composition according to the present invention, wherein a surface treated fibrous web is obtained and
- drying the surface treated fibrous web.

According to one embodiment of the invention the surface treatment composition is applied on the surface of the fibrous web, such as paper or board web, when the dryness of the web is >60%, preferably >80%. According to one embodiment fibrous web is dried to at least 90% dryness prior to apply surface treatment composition on the surface of the fibrous web. It is not advantageous to add the surface treatment composition according to the invention at wet-end on web having lower dryness because the components and especially free glyoxal may not retain sufficiently, therefore to be added at the drying section.

According to one embodiment of the invention the application temperature of the surface treatment composition is >50° C., preferably 50-90° C., more preferably 65-85° C., even more preferably 60-80° C. This improves the stability of the surface treatment composition, especially when it comprises a starch component. The surface treatment compositions according to the present invention thus tolerate even high application temperatures, without degradation or other negative effects. The surface treatment composition of the present invention may be applied on the surface of paper, board or the like in a conventional surface sizing arrangement, such as metering size press, pond size press or spray sizer.

According to some embodiments the fibre stock comprises at least 50%, preferably at least 60%, such as at least 70% or at least 80%, or even up to about 100%, on dry weight basis, based on the paper, board or the like such as an individual ply thereof, of recycled fibre material. These embodiments may benefit significantly from the present invention as fibres obtained from the recycled fibre material may have undergone several rounds of recycling, which deteriorates the intrinsic strength of the fibre and general quality such as fibre length, thereby deteriorating the end use properties of the paper, particularly the strength. Reduced intrinsic strength can increase the risk of paper web breakages, negatively impacting productivity and overall process efficiency.

Especially, it has been observed that applying the surface treatment composition according to the invention with the size press starch solution onto the paper or board surface, the resulting paper or board develops much higher permanent wet strength (30 min soak wet tensile) than the mixture using polyacrylamide with size press starch. By improving the wet strength by surface application, it may be possible to decrease the dosage of wet strength agents in the fibre stock. Increasing permanent wet strength by surface application, repulpability may remain unaffected, as the case may be when permanent wet strength agents such as PAE are added to the fibre stock.

The surface treatment composition and method for producing paper, board or the like according to the invention may provide a further benefit of enhanced recycling of unusable surface treated fibrous web, i.e. broke, as less harsh conditions may be used in the pulper to break down the broke, and the amount of reject may be decreased. Furthermore, when using starch, especially degraded starch, in the surface treatment composition, the in-situ reaction between glyoxal, anionic polyacrylamide and starch may render the starch associated or networked with the other materials thereby enhancing its molecular weight and/or charge in the pulped broke. In that way it may be easier to get the starch retained to a fibre web that is manufactured using the pulped broke originating from the surface treated fibrous web, thereby achieving reduced amount and accumulation of the starch in the circulating waters, lower COD, and even reduced consumption of wet end additives.

In an embodiment of the invention the surface treatment composition is applied on the surface of the paper or board web in such amount that the dosage of the surface treatment composition is about 0.5-80 kg/ton paper/board as dry, preferably about 1-40 kg/ton or 1-30 kg/ton paper/board as dry, calculated as dry. The surface treatment composition may be applied on one side of the fibrous web or on both sides of the fibrous web.

According to the method of the present invention it is advantageous that there is also a drying step after the application of the surface treatment composition according to the present invention so as to promote the aldehyde groups present in the composition to react with the anionic polyacrylamide and with other materials carrying hydroxyl, amine, amide or other groups capable of reacting with glyoxal. In principal any conventional drying temperatures and conditions may be used, such as 95-120° C. The higher the temperature the more aldehyde groups may react with anionic polyacrylamide. Further, the polymer retention and working efficiency can be increased when applying the surface treatment composition according to the invention to the surface of the paper or board through size press. The retention of the chemicals applied by the size press application can be close to 100% compared to wet-end applications. A further benefit of the present invention is that as the paper strength may be improved by surface application instead of wet-end application of common strength additives, it is possible to reduce or avoid the drawbacks that the addition of common strength additives to fibre stock may have for example on drainage, dewatering, flocculation or formation.

According to an embodiment of the invention, the method may further comprise coating the surface treated fibrous web with a coating composition and drying the coated fibrous web. The coating composition used in the method according to the present invention may be any coating composition commonly used depending on the desired properties of the paper or board to be manufactured.

EXPERIMENTAL

Some embodiments and aspects of the invention are described in the following, non-limiting, examples.

Example 1

APAM1 is an anionic polyacrylamide obtained by solution polymerization, with solids content of 20 weight-%. The mixture of APAM1 and glyoxal (40 weight-%) was prepared using the weight ratio of 70:30 on dry basis by physically mixing these two chemicals and dilution water. Final dry content of the mixture is 16.1 weight-%. This is further mixed with a degraded starch solution.

The surface treatment compositions used in the present experiment are shown in Table 1.

The surface application was conducted by using a laboratory size press unit. The pick-up rate of the size press solution made by blending starch and other chemicals was determined by the difference between paper sheet before and after treatment. The temperature of the size press solution was maintained about at 70° C. in order to simulate the commercial size press operational conditions on typical paper machines.

Basesheet:

Pilot machine made ASA sized paper with a basis weight of 33 lb/3300 $ft^2$, 15.8% ash content, HST values of 6-8 seconds.

Size Press Starch:

Cook 7.8% Ethylex 2025 size press starch using the laboratory starch cooker.

Sheet-Curing:

After surface treatment of paper samples, they were dried using the pilot drum dryer about at 105° C., thereafter they were cured for 15 minutes at 105° C. in a forced air oven.

TABLE 1

Paper Strength Results

| Run | | Pick up rate lb/ton of | IWT lb/in | | 30 Min-Soak WT lb/in | | Dry Tensile | |
|---|---|---|---|---|---|---|---|---|
| # | Chemistry | paper | Avg. | %*) | Avg. | %*) | Avg. | %*) |
| 1 | Blank with water | 0 | 1.82 | — | 0.66 | — | 7.54 | — |
| 2 | Starch 7.8 w-% solution | 67 lb starch only | 1.96 | — | 0.7 | — | 11.78 | — |
| 3 | 2 w-% of APAM1 in 7.8 w-% starch solution | 55 lb starch and 14 lb APAM1 | 2.7 | 38 | 1.25 | 79 | 17.7 | 50 |
| 4 | 2 w-% of the mixture of APAM1 and glyoxal (70:30) in 7.8 w-% starch solution | 55 lb starch and 14 lb the invention | 4.5 | 130 | 3.2 | 357 | 21.34 | 81 |

*) increase compared to starch control (%)

The wet strength synergic effect of the mixture of APAM1 and glyoxal was observed via the size press paper surface treatment. Addition of the mixture of anionic polyacrylamide and free glyoxal into the size press starch solution significantly improved paper wet tensile strength over the control condition, i.e. starch alone, and also over the APAM1 control despite of the slightly lower polymer dosage (10 lb of APAM1 in the strength agent of the invention run #4, versus 14 lb of APAM1 in run #3).

Example 2

The base papers were from a recycled board grade (OCC) with 2.5 lb/ton of AKD as the internal size.

Experiment:

Size Press Study:

The base paper was cut to the dimension of 6 inch by 10 inch. The Caliber 182 starch was cooked at 13% solids, and further diluted to 12%. The size press solution was transferred to a pan after addition of strength additives. The sheets were dipped in and completely subemerged in the solution, and then taken out immediately. After that, sheets went through a Werner Mathis press with 75% pressure and 3 m/min speed setting. Wet pickup was monitored and sheets were dried at 105° C. Prior to paper physical testing, sheets were conditioned overnight with constant temperature at 23° C. and humidity at 50% R.H.

Tensile Strength, Dry:

Tensile strength was measured by applying a constant-rate-of-elongation to a sample and recording three tensile breaking properties of paper and paper board: the force per unit width required to break a specimen (tensile strength), the percentage elongation at break (stretch) and the energy absorbed per unit area of the specimen before breaking (tensile energy absorption). This method is applicable to all types of paper, but not to corrugated board. This procedure references TAPPI Test Method T494. Twelve measurements were taken per condition. A Thwing-Albert QC3A tensile tester was used.

Tensile Strength, 30 Minutes Soak:

Tensile strength was measured by wetting the sample strips in deionized water for 30 minutes, removing excess water from the specimen, and then applying a constant-rate-of-elongation to a specimen and recording the force per unit width required to break the specimen. This is the tensile strength, which is the maximum tensile stress developed in the test specimen before rupture. This method is applicable most commonly on paper towel and paper board. This procedure references TAPPI Test Method T456. Eight measurements were taken using Thwing-Albert QC3A tensile tester.

STFI Compression:

STFI compression test (zero span) was used to determine the compressive resistance for paper board application. A test specimen is placed in two clamps that are forced towards each other until a compressive failure occurs. The maximum force causing failure is measured, and reported in the unit of lb force/in or kN/m. The higher the value, the higher the compressive strength of the board. This test follows TAPPI Test Method 826 pm-92: short span compressive strength of container board. At least 12 measurements for CD and four measurements from MD were taken per condition using L&W compressive strength tester STFI and average value and standard deviation were reported.

Figure 2:
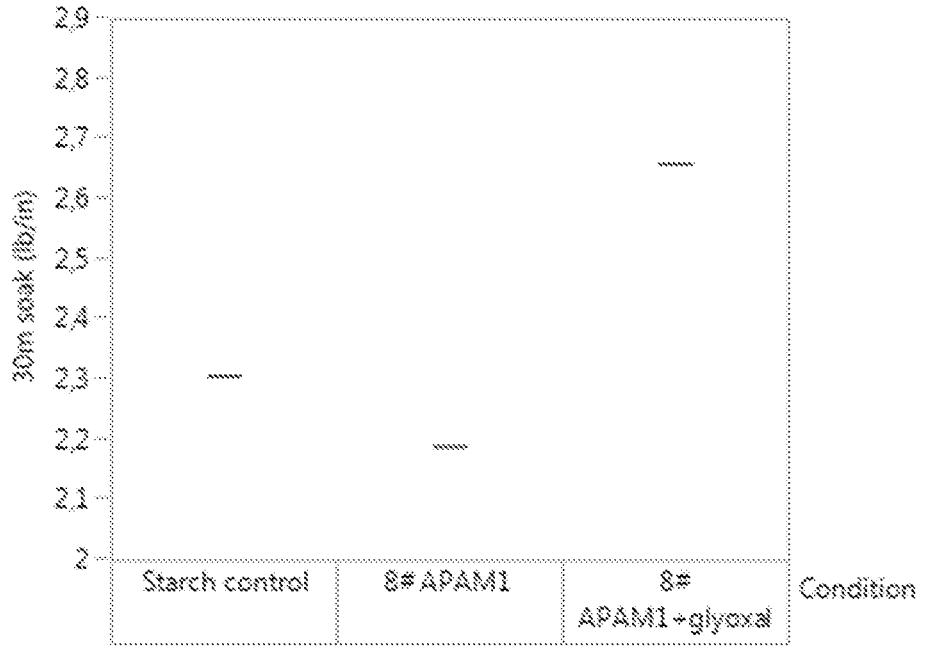
FIG. 2 shows the wet tensile results after 30 minutes soak according to Example 2.
Figure 3:
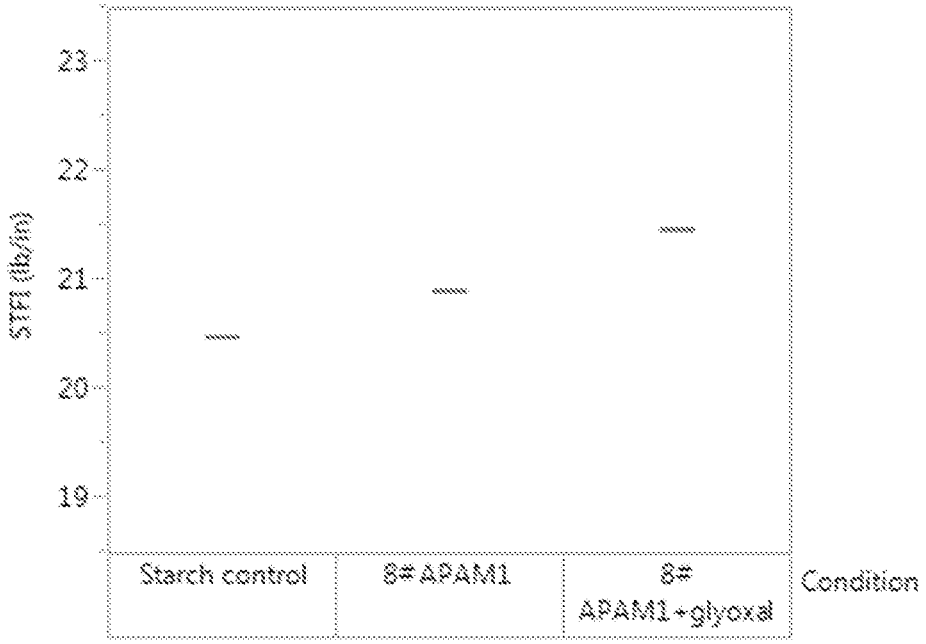
FIG. 3 shows the STFI compression test results according to Example 2.

The dry tensile results are shown in FIG. 1, the wet tensile results after 30 minute soak representing permanent wet strength are shown in FIG. 2, and the STFI compression results are shown in FIG. 3. The surface treatment composition comprising the strength agent according to present invention and starch showed 21.4% increase on 30 minutes soak tensile compared to anionic polyacrylamide APAM1 with starch, and 15.2% higher than starch control. For dry tensile, the surface treatment composition comprising the strength agent according to present invention and starch achieved 6.3% improvement over anionic polyacrylamide APAM1 with starch and 11.1% over starch control. Also, the improvement of STFI compression strength was increased significantly by the surface treatment composition comprising the strength agent according to the invention and starch compared to starch control, and APAM1 with starch. STFI is a very important strength property for many board grades, characterizing a board's resistance to edgewise crushing forces required for example when stacking board boxes. However, it is far more difficult to gain than many other strength properties, such as dry tensile.

The invention claimed is:

1. A surface treatment composition for application on a surface of paper or board, wherein the surface treatment composition comprises:

an anionic polyacrylamide, which has an average molecular weight, MW, in a range of 100 000-2 000 000 g/mol, and comprises anionic monomers and (meth)acrylamide in a molar ratio of 3:97 to 30:75;

10-90 weight-% of free glyoxal, calculated from anionic polyacrylamide (dry/dry); and 99.5-1 weight-% degraded starch, calculated from a dry content of the surface treatment composition, wherein the dry content of the surface treatment composition is 2-25 weight-%, calculated from the total weight of the composition.

2. The surface treatment composition according to claim 1, wherein the pH of the surface treatment composition is below 5.

3. The surface treatment composition according to claim 1, wherein the dry content of the surface treatment composition is 10-20 weight-%, calculated from the total weight of the composition.

4. The surface treatment composition according to claim 1, wherein the surface treatment composition further comprises glyoxalated polymer.

5. The surface treatment composition according to claim 1, wherein the anionic polyacrylamide has the average molecular weight in a range of 200 000-1 000 000 g/mol.

6. The surface treatment composition according to claim 1, wherein the anionic monomers of the anionic polyacrylamide comprise unsaturated carboxylic acid monomers selected from (meth)acrylic acid, maleic acid, crotonic acid, itaconic acid or any combination thereof.

7. The surface treatment composition according to claim 1, wherein the anionic polyacrylamide comprises anionic monomers and (meth)acrylamide in a molar ratio of 5:95 to 20:80.

8. The surface treatment composition according to claim 1, wherein the surface treatment composition comprises free glyoxal 20-80 weight-%, calculated from anionic polyacrylamide (dry/dry).

9. The surface treatment composition according to claim 1, wherein the surface treatment composition further comprises hydrophobic surface sizing polymer.

10. The surface treatment composition according to claim 1, wherein the surface treatment composition comprises degraded starch in an amount of 95-55 weight-%, calculated from the dry content of the surface treatment composition.

11. The surface treatment composition according to claim 1, wherein the pH of the surface treatment composition is below 4.

12. The surface treatment composition according to claim 1, wherein the pH of the surface treatment composition is below 3.

13. The surface treatment composition according to claim 1, wherein the surface treatment composition further comprises glyoxalated polyacrylamide.

14. The surface treatment composition according to claim 1, wherein the surface treatment composition further comprises styrene acrylic acid ester polymer, styrene maleic anhydride polymer, styrene maleic anhydride ester polymer, styrene acrylic acid polymer, ethylene acrylic acid polymer, polyurethane dispersion, or any modification or combination thereof.

* * * * *